United States Patent [19]

Collins

[11] 4,042,241

[45] Aug. 16, 1977

[54] ELASTIC CORD-ATTACHED RETURNING SOCCER BALL

[76] Inventor: Copp Collins, 1225 Martha Custis Drive, Alexandria, Va. 22302

[21] Appl. No.: 599,857

[22] Filed: July 28, 1975

Related U.S. Application Data

[63] Continuation of Ser. No. 468,460, May 9, 1974, abandoned.

[51] Int. Cl.[2] ..... A63B 69/00; A63B 69/26

[52] U.S. Cl. ..... 273/95 A; 273/58 C; 273/DIG. 17; 273/DIG. 18; 273/DIG. 19; 403/291

[58] Field of Search ..... 273/26 E, 58 R, 58 B, 273/58 C, 95 A, 97 R, 98, DIG. 18, DIG. 19, DIG. 20; 403/291; 124/17, 20; 272/135, 142

[56] References Cited

U.S. PATENT DOCUMENTS

| | | | |
|---|---|---|---|
| 2,186,016 | 1/1940 | Evans | 273/58 C |
| 2,924,459 | 2/1960 | Bryant | 273/58 B |
| 2,933,832 | 4/1960 | Ayala | 273/DIG. 18 |
| 3,165,315 | 1/1965 | Petrusek | 273/58 C |
| 3,214,166 | 10/1965 | Gaudet | 273/95 A |
| 3,804,409 | 4/1974 | Schachner | 273/58 C |

FOREIGN PATENT DOCUMENTS

| | | | |
|---|---|---|---|
| 728,648 | 4/1932 | France | 273/DIG. 19 |

*Primary Examiner*—Richard C. Pinkham
*Assistant Examiner*—Arthur S. Rose
*Attorney, Agent, or Firm*—Larson, Taylor and Hinds

[57] ABSTRACT

A tethered inflated athletic ball resembling a ball used in the playing of soccer, with an elastic cord secured at one end thereto and provided at its other end with at least one flexible loop which fits around a member of the human body— such as the foot, ankle, head or neck. The ball upon rebound strikes a part of the body in motion, which in turn drives the ball to the elastic limit of the cord and return again. (This continuous, simulated soccer play or practice permits the user to remain in a stationary position, yet experience the exercise, skill and enjoyment of soccer play with having to retrieve the ball or play with a partner.)

4 Claims, 7 Drawing Figures

ELASTIC CORD-ATTACHED RETURNING SOCCER BALL

This is a continuation of application Ser. No. 468,460 and now abandoned, filed 5/9/74.

This invention relates to a combined inflated, soccer-type, round athletic ball with a connected elastic cord or tube assembly (or elastic strip or band of specified dimensions) designed for instant attachment, on the cord at the opposite end from the ball, to a portion of the human body such as the foot, ankle, calf, knee, thigh, waist, neck or the head. An important object of the invention is to provide a device of this kind which is useful in teaching the rudiments of the game of soccer, and for the practice of soccer technique by one person or more, without allowing the ball to travel or bounce over a larger area away from the body, and without the necessity of having to retrieve the ball, since it returns to the player. Another object of the invention is to provide a novel device suitable for simple recreation and exercise outdoors, and in certain unrestricted areas indoors. A further object of the current invention is to provide a durable construction in manufacture to withstand the rigorous practice or play with the device through the unique method of manufacture and the manner of its attachment to the user's body.

The elastic cord or tube or other elastic attachment to the ball of the present invention permits the ball to be self-returning at diverse angles to the player for repeated kicks by the foot or reaction by various parts of the body, providing a simulated and actual action of the game of soccer.

The game of soccer football (or football, as it is called in other nations of the world outside the United States) requires a high order of skill in the initial kicking of the ball in a selected direction, either by performing the kicking from the inside of the foot's arch, the toe, the instep, the outside, or rarely, the back of the foot. Also, the ball may be propelled by meeting the ball in mid-air with the head, in a quick jerk-of-the-head motion which bounces the ball in various desired directions, depending on the skill of the player. In the actual game, competing eleven-man teams propel or "pass" the ball to players by kicking or making it rebound from all parts of the body except the arms and hands *(the latter being illegal) to achieve a goal at either end of the playing area, or "pitch"—an area larger than an American football field. The soccer ball is activated at varying speeds and elevations, parallel or diagonally relative to the ground, and it follows a dazzling variety of erratic courses. Mastery of the game thus requires constant practice beginning at a youthful age and continuing with frequency if the player is to maintain his coordination and skill with the ball.

*Note: The goalie, protecting the goal area, of course, is permitted to use arms, hands, any part of the body, but other players amy not use their arms and hands in play.

This invention provides a practice ball that returns to the kicker as well as a game or toy ball for recreation by the player, alone or with others. The skillful player learns to judge the characteristic speed or angle of each approaching ball return, and make an instantaneous decision as to the best way to meet the ball —with foot, knee, chest or head-on force and this invention provides all of the practice conditions the player may face during an actual game. This will assist coaches and players conducting clinics in soccer for young players to teach the game more quickly. It provides recreation while learning the game of soccer as well, thus gaining more attention from the beginning player.

The device of the present invention cause the ball, once it is kicked or otherwise propelled by the player, to return to the player when the elastic cord or tube (or elastic strip or band) is stretched out, (with the same variety of trajectories, speeds, and erratic courses as is provided by the actual game, with participating teams and opposing players).

The ball itself can be regulation soccer size, as specified in both United States and International soccer rules, or it can be a smaller ball, and it is attached to an elastic cord, tube or hand at one end, and at the other or opposite end of the elastic attachment, a single or double loop is provided which receives, or fits around the foot of the player, or which is slipped around the player's foot or ankle or other member of the body. The double loop, one horizontal to the ground and the other perpendicular encircles the ankle and also goes around the arch and instep of the foot, preventing the cord or other attachment from working upwardly as the foot action becomes more intense. To attach to the calf, knee, thigh or head, the perpendicular loop is slipped off from under the foot and the horizontal loop is stretched or adjusted around those body parts. Thus, the ball, when kicked outwardly, will return approximately to the lower or higher level to which the loop is attached, providing the simulated action of the ball in game play. The invention is not limited to a ball of any given size. A smaller ball can be a size of about the diameter of a regulation softball; another size can be a "peewee" ball, as is generally known in soccer circles; a still larger size would be slightly smaller than a soccer ball of regulation size, sometimes called a toy size; and the largest would be the regulation size soccer ball. In each case, the size of the ball and the length of the cord may vary. Also, in the smaller size, an elastic cord may be attached to the ball, rather than an elastic tube. The tube would be utilized with the larger balls, and the tube is used for inflating the ball as indicated below. In the peewee-size ball, a smaller elastic band of tested specifications would be substituted for the larger elastic cord or tube necessary on the larger soccer-type balls, which are heavier and require more strength in the elastic attachment.

Each additional point of attachment of the elastic cord or other attachment to the body presents new pathways for the ball to travel, and new problems to effect a driving action with the ball.

Figure 3:
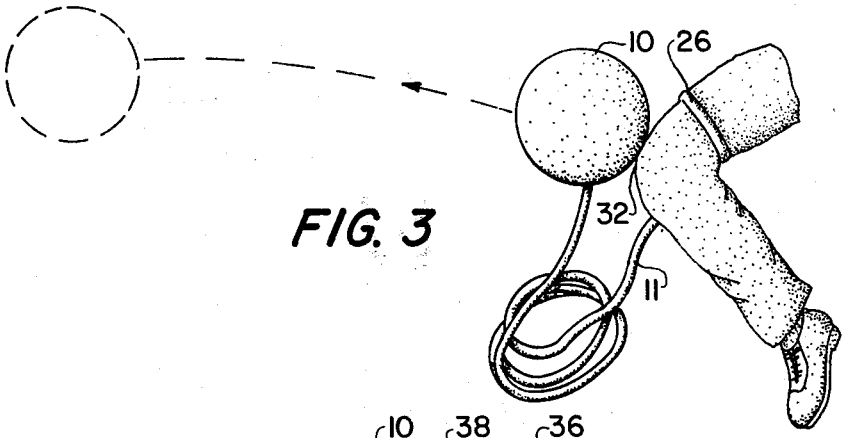
FIG. 3 shows a common usage of the soccer return ball of the present invention wherein the ball on rebound strikes the knee of the player, simulating actual action which takes place in a regular soccer match.
Figure 3A:
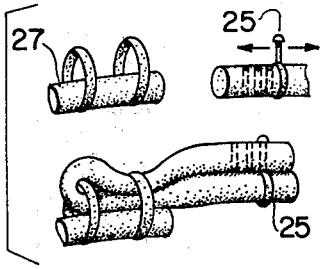
Figure 4:
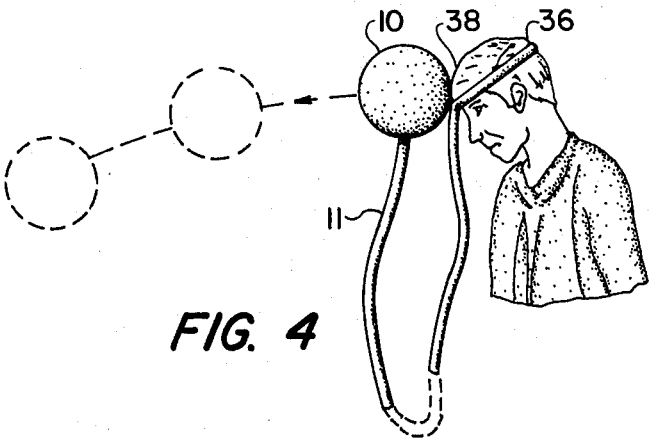
Figure 5:
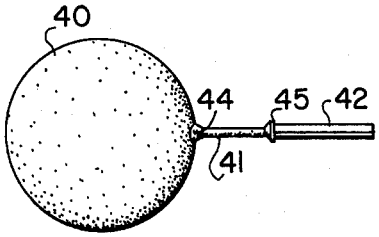

FIG. 3-A is a variation of the knee loop in more detail;

FIG. 4 is a similar view, but shows the ball striking the head of the player, and the loop attached to the head to achieve this return effect to the head area;

FIG. 5 is a view showing the modification in connection, or adaptation of the cord or tube, or elastic strap with the ball.

The soccer return ball of the present invention is shown at 10, FIG. 3, and it has attached thereto a cord or tube or strap (band) at 11; the cord is preferably or rubber or other elasticized material which is secured at its outer end by any suitable means to the ball. One such means, used in connection with a regulation soccer ball, is to intertwine the cord into the lacing 12, FIG. 1, of the ball, knotting it securely, which is accomplished through the punching of two holes in the cord as shown in detail at FIG. 1, 17, which provides means of slipping the lacing through the holes of the cord after inter-twining to tighten, since a plain cord will pull loose in kicking the ball. The other end of the elastic cord has two loops 14 and 16, FIG. 1, one of which extends around the ankle indicated at 18, and the other of which extends around the instep and below the arch portion of the shoe shown at 19. The attaching means is thus positioned firmly around the foot, preventing the cord, tube or strap from rising on the leg. This is most important, since the most popular use of the ball consists in kicking it at, or just above, the ground level, as in the game of soccer.

Figure 1:
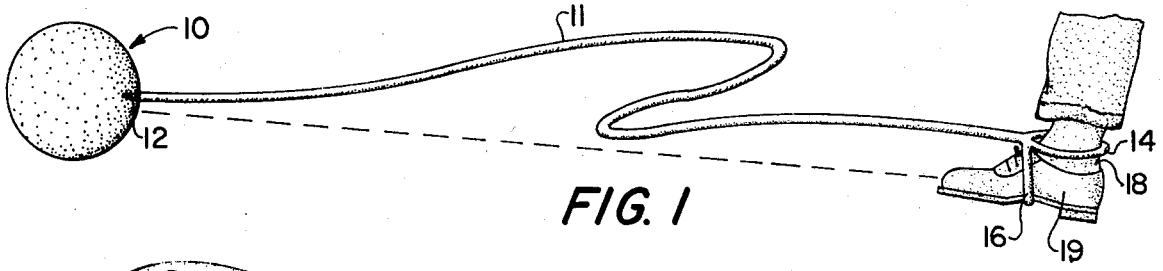
FIG. 1 is a view of a return ball of the present invention attached to the foot and ankle of the player, with both horizontal and perpendicular loops of the elastic cord shown.
Figure 1A:
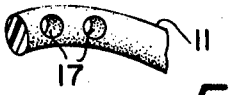
Figure 2:
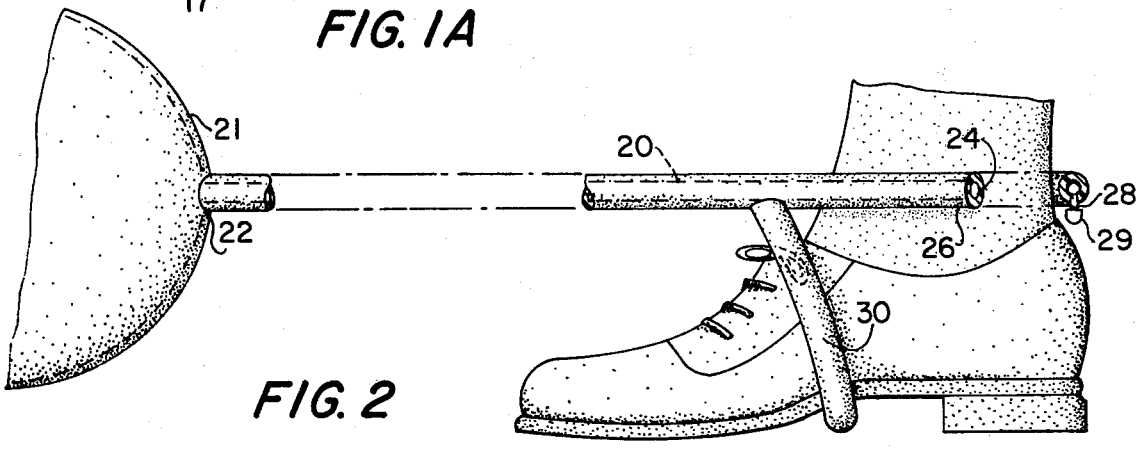
FIG. 2 is an enlarged broken elevation and showing further details of the attachment means.

A more sophisticated and preferred form of the invention is shown in FIG. 2 wherein the cord of FIG. 1 is replaced by a stout, but very flexible elastic rubber tube 20, with a small internal air passage, which provides more elasticity, rather than a common tube of rubber with narrow walls and very little strength. It is important in the design, that the tube be of thick, high-quality rubber or substitutent, permitting a tiny air passage for use in inflating the ball as shown at 24. The attaching means in this instance includes a flexible, disc-like terminal 22 fused inside the ball and formed integrally with both the tube and the ball as is done in some currently produced athletic bladders for sports balls, wherein the bladder's short stemmed filling hose is made a part of the ball itself for strength. The same would be achieved in manufacture of the ball with the tube attached.

The ball is generally made of rubber, plastic material or leather, or any other durable material, depending on the best available ball covering on the market. The internal passage or airway 24 extends around the horizontal loop section 26 at the ankle, and at the rear a valve 28 extends downwardly and has an air cap which opens for filling, made of rubber cover, and is closed after inflation of the ball through the tube into the ball. The second loop around the instep and arch shown at 30, is similar to attachment in solid elastic cord shown in FIG. 1, 16.

One of the actions performed by the ball is indicated in FIG. 3 wherein the ball strikes the knee 32, since the loop 26 is moved either above or just below the knee and the ball rebound contacts the knee area and again travels outwardly, tending to return to the point of contact. Yet another type of action is shown in FIG. 4, where the loop encircles the head of the player (or the neck in similar fashion) and the ball rebound makes a direct line for the head area 38 of the player. After being placed on the ground and kicked outwardly, the ball extends out to the fullest extend of elasticity of the cord, tube or strap and returns upwardly to the head and neck area because of its being attached in that area, thus simulating the playing action of the game of soccer in which the ball travels similarly and is hit by the head to propel it on to a teammate, or attempt to make a goal. This provides head action and exercise, and practice as actually happens in match soccer play.

The most effective use of the elastic cord soccer return ball of the present invention, however, is shown in FIG. 1 and FIG. 2, wherein the ball approaches the player either along the ground level or slightly above it. It is thus in the most favorable position for kicking by the player, which is the manner in which the ball is propelled mainly in the game of soccer, and in which it can be kicked along the ground or up in the air; kicked into a simulated goal area (which may be set up for practice inside or outside) or kicked out and back repeatedly to establish a record for amateur athletic competition in continuous kicking for maximum number of times, or for anateur play and recreation; or for practice and training amateurs or professionals. Another variation in the use of the present invention is for an executive relaxer or form of mild exercise, wherein a goal-like arrangement would be included in the marketing of the soccer return ball, or the goal could be made a part of the box in which the ball is shipped and sold. This could be used by children and adults alike, inside or outdoors; at school or at home.

Since the angle of attack by the foot in soccer is mainly from a 45° approach of the inside of the foot to the path of the kicked ball, which is opposite to the straightahead punting or kick-off booting in U.S. football, the present elastic cord soccer return ball provides an ideal method of learning the proper angle of soccer attach with the foot, and also provides a continuing varied action, once the ball is in motion. The ball returns repeatedly, pulled back to the player by the elastic cord or tube, strap or hand. This also makes it possible for a single player to derive much more practice by himself, without having to recover the ball played in regular soccer, for the present invention simulates soccer action correctly as though another player or group of players were participating with the ball.

A modification is shown in FIG. 5 wherein the ball 40 has a swivel connection 41 with the tube 42. This may be done by providing two hollow conical members 44 and 45, which are attached to the ball and cord, respectively, and have holes at their ends to receive the headed swivel connecting pin 41. This can be attached similarly with the elastic cord or strap or band (see strap shown in FIG. 5., 42.) The advantage of the swivel is to allow the ball to twist and turn around in the air without becoming entangled, but the swivel is not a necessary attachment to the basic idea of the current invention.

The modification of the elastic cord or strap (band) shown in FIG. 3-A, 27 enlargement of elastic cord, provides a means of fitting more flexibly the loop around knee or other body areas through the application of two double loops of rubber, metal, plastic or other material fixed to the loop end, and fitting into the other loop end similarly to a belt on certain raincoats, in which one part of the loop end is thrust through the two rings; slipped up and around and back through the first ring as shown. FIG. 3-A, 25 shows a pin (leather or plastic) and ring attached to the loop-end elastic cord with a small knob on the end of the pin which fits through the cord or strap end through a hole in a series of holes, locking the end of the cord after fitting it back through the double rings. This is to provide a longer fit around the waist or larger part of the body if the loop does not extend far enough around. The pin hold the elastic from slipping loose. The regular loop is secure because it is made in one piece, needing no pin.

A modification in attachment to a solid rubber ball is provided by manufacturing of the ball and cord or strap into a single integral joining together. For open mesh practice balls of plastic make, a simple strap with a slit the width of the strap would permit running the strap or band through the open mesh, back around through the slit in the strap, which would be about one inch from the end of the strap.

What is claimed:

1. An inflated athletic ball resembling a ball used in the playing of soccer, provided with an elastic cord secured at one end thereto and extending therefrom and provided at its other end with at least one loop which receives a member of the human body such as the leg, calf, thigh, waist, neck or head, and whereby the ball, after being propelled, is enabled, upon rebound, to strike a part of the body of the user so as to drive the ball outwardly again to the elastic limit of the cord, said cord including an internal passage forming an airway extending into the ball and a normally closed valve at the opposite end of the cord which is opened while inflating the ball.

2. A practice device as claimed in claim 1 further comprising swivel means for securing said elastic cord to said ball comprising a headed swivel pin and at least one connecting member having an aperture therein for receiving said headed swivel pin so as to pivotably connect said elastic cord to said ball.

3. A practice device for soccer as claimed in claim 2 wherein said headed swivel pin includes first and second swivel heads respectively located at opposite ends thereof and said swivel means comprises a first hollow conical swivel member secured to said ball and having an aperture therein for receiving said fist swivel head and a second hollow conical swivel member secured to said elastic cord and having an aperture therein for receiving said second head of said headed swivel pin.

4. A practice device for soccer comprising an inflated athletic ball resembling a ball used in the playing of soccer, and an elongate elastic cord, which is secured at one end to said ball and which includes at least one loop at the other end thereof for receiving a portion of the body of a user, for enabling automatic return of the ball to the user after the ball has been propelled away from the user, said at least one loop comprising an adjustable loop having first and second free ends, and first and second annular elements attached to the loop adjacent said first free end of the loop for receiving the second free end of the loop whereby the second free end is inserted through the first and second annular elements, looped around the annular element furthest from the first free end and inserted back through the other annular elements, and means for fixing the second free end in place, a portion of said loop including a series of holes spaced along the length thereof and said fixing means comprising a pin which is adapted to be selectively fit into one of said series of holes.

* * * * *